United States Patent [19]

Bates

[11] 4,017,036

[45] Apr. 12, 1977

[54] CONTROL OF THE LINEAR SPEED OF THE WEB

[76] Inventor: Emile Bernard Bates, 11 Barrington Road, Stoneygate, Leicester, England

[22] Filed: July 8, 1975

[21] Appl. No.: 594,083

[30] Foreign Application Priority Data

July 11, 1974 United Kingdom ..... 30691/74

[52] U.S. Cl. ..... 242/75.5

[51] Int. Cl.[2] ..... B65H 17/06

[58] Field of Search ..... 242/75.5, 75.51–75.53, 242/67.1–67.5

[56] References Cited

UNITED STATES PATENTS

| | | | |
|---|---|---|---|
| 2,887,280 | 5/1959 | Bowen | 242/75.5 |
| 2,929,193 | 3/1960 | Cook | 242/75.5 X |
| 3,516,619 | 6/1970 | Azuma | 242/75.5 X |
| 3,781,490 | 12/1973 | Phillips | 242/75.5 X |

*Primary Examiner*—Stanley N. Gilreath
*Assistant Examiner*—John M. Jillions
*Attorney, Agent, or Firm*—Michael J. Striker

[57] ABSTRACT

This invention is concerned with providing means which control the linear speed of a web travelling from a source of that web to a take-up spool and is particularly associated with ensuring that the linear speed of travel of the web from the one source to the take-up is maintained constant. The invention therefore has application to the textile trade where a web of textile material may be passed through a dye bath and it is desirable to ensure that all parts of the web are immersed in the dye bath for the same length of time.

The invention includes means for sensing the speed of travel of the web and comparing it against a known reference speed and by comparing the two speeds providing a positive or negative signal which is fed to apparatus which then increases or reduces the speed of travel of the web in order to maintain it constant.

6 Claims, 4 Drawing Figures

CONTROL OF THE LINEAR SPEED OF THE WEB

This invention is for improvements in or relating to means for controlling the linear speed of a web travelling from a source of supply of said web to a take-up spool for said web. The invention is particularly concerned with the apparatus for controlling the linear speed of a web such as a web or textile cloth which is being progressed from a drum or spool or the like on which the cloth has been wound through certain processing means to a take-up drum onto which the cloth is to be wound. It is in some instances most essential that the linear speed of a cloth between the source supply and the take-up be constant; this is particularly true when the cloth is to be processed by the transfer printing dyeing process in which textile cloth is progressed in juxtaposition to paper or similar base material which has been printed with sublimable dyes and while in juxtaposition the paper and cloth are subjected to a heat treatment so that the dyes sublime from the paper onto the textile material.

There are many other instances where there exists the need to maintain the linear speed of a web of textile material constant such as for example where a web of textile material is to be passed back and forth through a bath of dye liquor.

It will be appreciated that if one end of the fabric is moved through the dye liquor at a greater linear speed than the other, then such end may be dyed to a less deep shade than the end which passes through the dye liquor at a slower speed thus having a longer time to be impregnated with the dye.

It will also be appreciated that in the use of textile cloths it is desirable that subsequent lengths of cloths should be dyed to substantially the same if not identical shade and characteristics as previously dyed and processed cloths. Hence the need to ensure uniformity of the processing of a web of textile material which is to be subjected to a processing treatment while it is passed from a source of supply to a take-up.

It is therefore an object of the present invention to provide apparatus which assists in controlling the linear speed of a web in the forementioned manner.

Accordingly the present invention provides apparatus for controlling the linear speed of a web travelling from a supply source to a take-up spool comprising means for sensing the speed of travel of the web, means for comparing said speed with a reference speed and means for adjusting the drive causing the web to travel according to the results of said comparison.

Desirably, the invention provides for means which are driven by the web as it travels from the source of supply to the take-up spool. Said means may for example drive a shaft. A reference shaft is driven at a constant speed by a monitoring device, such as for example a synchronous motor so that the speed of said reference shaft remains substantially constant.

Means are then provided for comparing the relative speeds of rotation of the reference shaft to the shaft driven by the web and a plus or minus signal is obtained according to whether the shaft driven by the web is running faster or slower than the reference shaft.

Means are then provided for applying this reference signal in a plus or minus sense to the drive for the web so as either to slow it down should it be running faster than the reference shaft or to speed it up should it be running slower than the reference shaft.

In a particular embodiment the two shafts are driven in the same direction and each has disc at the end thereof. The shafts are in axial alignment and one of said discs may be provided with an electric contact member and the other of said discs with two electric contact members spaced 180° of arc apart. If the two shafts are rotating at the same speed then the single contact member on one disc will remain in fixed relationship relative to the two contact members on the other disc and will not contact said members. If however, one of said shafts is rotated at a different speed relative to the other shaft then one or other of the contact members will come into contact with an electrical signal so produced may be applied by means hereinafter described to adjust the relative speeds of rotation of the shafts.

In another specific embodiment of the present invention the two shafts are rotated in contrary direction and a differential member rotated by said shafts is accommodated between them. If the two shafts are rotating at identical speed then the differential member will remain stationary, but if one of the shafts rotates at a speed different from that of the other shaft then the differential member will be angularly displaced relative to both of said shafts and may thereby contact a microswitch or the like to give the necessary positive or negative signal.

In order that the present invention may be more readily understood, reference is now made to the accompanying drawings in which.

Figure 4:
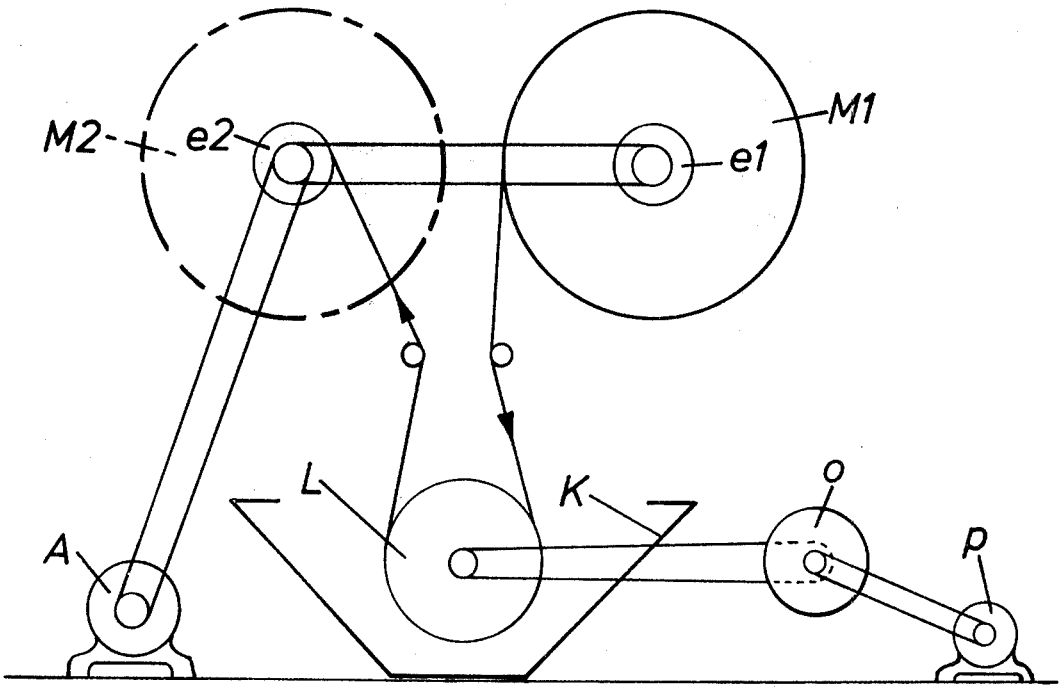
FIG. 4 is a schematic view showing the disposition of the parts and apparatus to which the present invention relates.

Referring first to FIG. 4 there is illustrated a drum ***e*1 on which there is supported a supply of a web indicated by a reference character M1 which may be, for example, textile material which is to be treated by a liquid such as a dye liquor located within a bath K. The web M1 passes around a freely rotatable roller L so as to ensure immersion of the web into the liquid in bath K. The web is then wound up onto a take-up drum *e*2 and eventually the diameter of the web M2 on the drum *e*2 will be in order of the diameter indicated by interrupted lines. The web is progressed from *e*1 to *e*2 by a drive arrangement A which rotates the drum *e*2** and includes a motor and further parts hereinafter described.

The roller L is adapted to drive, through appropriate belt means or through gearing if necessary, a speed comparison arrangement indicated at *o* which is driven by a synchronous motor *p* or some other rotating means. A synchronous motor is preferable because of the constancy of rotation of a synchronous motor provided the frequency of the source of alternating current driving it does not itself vary.

Figure 1:
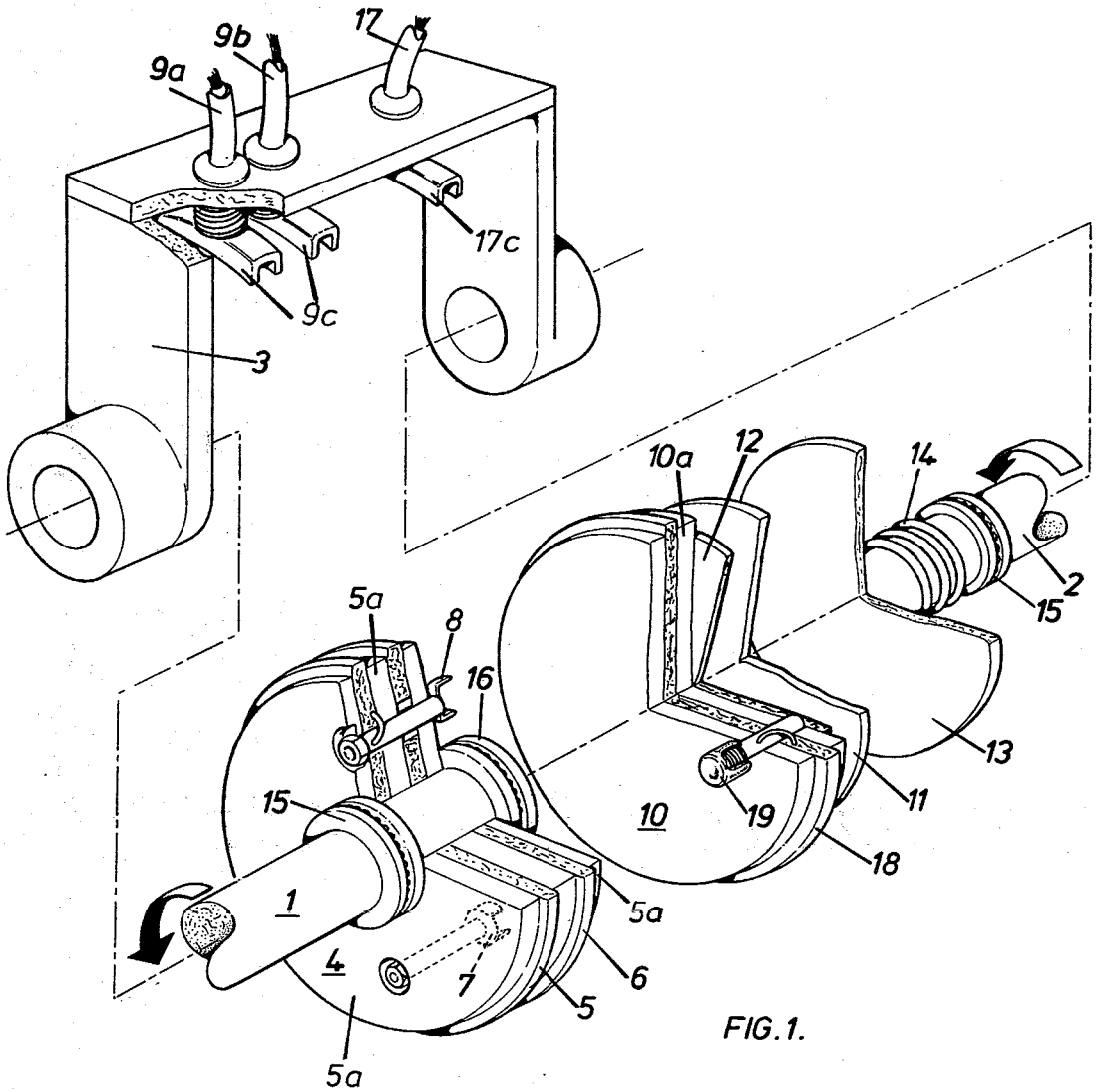
FIG. 1 is an exploded perspective view of one embodiment of the apparatus according to the present invention.

The nature of the comparison arrangement *o* may be of one of two forms of which one form is illustrated in FIG. 1 and consists of two shafts 1 and 2. Shaft 1 desirably will be driven directly from the drum L while shaft 2 is driven by the synchronous motor *p* of FIG. 4. Shaft 1 has mounted thereon two metallic discs 5 and 6 which are separated and endwise adjoined by electrically insulating discs 5*a*. The discs 5, 5*a*, 6 are assembled together and a contact member 8 projects from the face of the end disc 5*a* and is in electrical contact with disc 5. A similar contact member 7 which may be diametrically opposite the contact member 8 is in electrical contact with disc 6.

The peripheries of the discs 5 and 6 run in grooves of members 9*c* which form a part of an electric circuit including conducting wires 9*a* and 9*b* respectively for the discs 5 and 6 and leading to a speed controlling circuit. The discs 5 and 6 rotate relative to the members 9*c* and each acts in the manner of a slipring.

A thrust bearing 16 provides a fixed spacing of the insulating disc 5*a* from a disc 10 on the end of shaft 2. The disc 10 carries a contact member 19 which is in electrical connection with a disc 18 running in a member 17*c* which is in electrical contact with a conductor 17 also leading to the speed controlling arrangement hereinafter described. A metallic plate 12 backs the disc 18, being separated therefrom by an insulating disc 10*a* which plate 12 is in pressure contact with a slipring clutch arrangement consisting of a soft leather or similar material disc 11 in pressure contact with a metallic disc 13, due to a force of a coil spring 14 concentric with shaft 2. The coil spring 14 abuts against a thrust bearing 15. Thus as shaft 2 rotates, the disc 10 supporting the electrical contact member 19 rotates and if both shafts 1 and 2 rotate in the same direction, and at the same speed of revolution, then the member 19 will be in fixed angular relationship to the contact members 7 and 8 and will not move nearer either of them.

If however, shaft 1 increases its speed of rotation relative to shaft 2 then there will be a progression of the contact member 19 toward one of the contact members 7 and 8 and on making contact an electrical circuit will be established between the member 17*c* and either the member 9*a* or 9*b* as the case may be and this circuit is used to give a positive or negative signal according to whether shaft 1 is rotating faster or slower than the shaft 2. The signal is applied to the speed control arrangement hereinafter described. The purpose of the slipping clutch arrangement which includes the soft leather disc 11 is to enable the disc 10 to slip with the assembly of discs 5 and 6 relative to the metallic disc 13 until such time as the speed has been re-adjusted whereupon the contact member 19 will disengage from the contact 7 or 8 and the signal for adjusting the relative speeds of the shaft will be discontinued.

Figure 2:
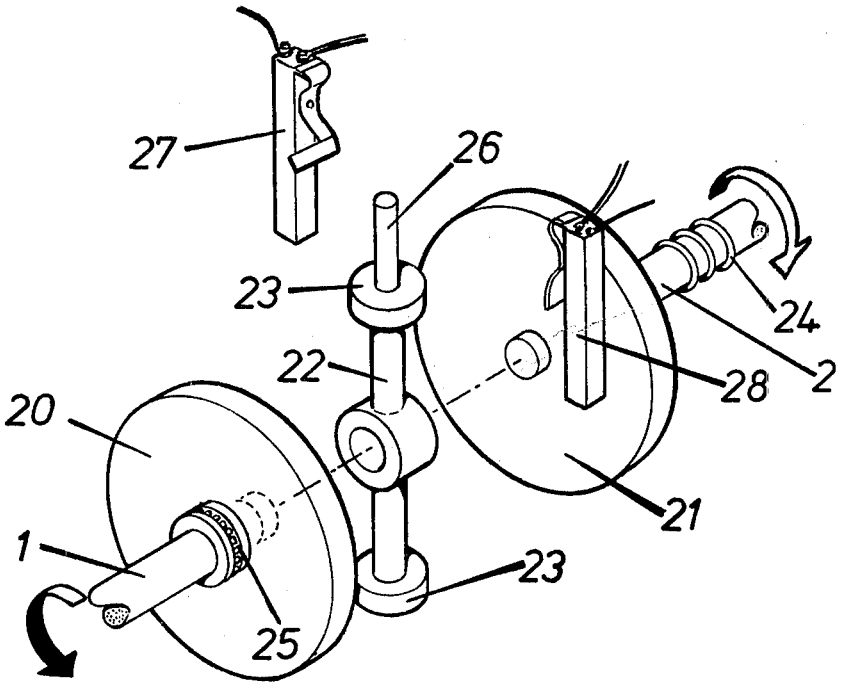
FIG. 2 is an exploded perspective view of an alternative embodiment.

In FIG. 2 an alternative construction is illustrated in which shaft 1 as illustrated in FIG. 2 is rotated by the drum L of FIG. 4 and shaft 2 is similarly rotated by the synchronous motor *p* of FIG. 4. The shaft 1 is connected by a thrust bearing 25 to an electrically insulating disc 20 and shaft 2 is connected to a similar disc 21. Mounted on an end portion of one of shafts 1 or 2 is a differential member consisting of a rod 22 with rotatable wheels 23 at each end thereof. The rod 22 has an extension 26 at one end.

It will be appreciated that, providing the shafts 1 and 2 rotate at the same speed in opposite directions, then the assembly of the rod 22 with the wheels 23 will remain stationary in an angular direction but if one of the shafts 1 or 2 rotates fast or slow relative to the other, then the assembly of the rod 22 and wheels 23 will begin to move in one angular direction depending on which of the shafts 1, 2 is rotating faster relative to the other. As the assembly moves, it — particularly the extension 26 thereof — may contact micro switches 27 or 28 closing a circuit to give an electrical signal to the speed controlling arrangement illustrated in FIG. 3.

Figure 3:
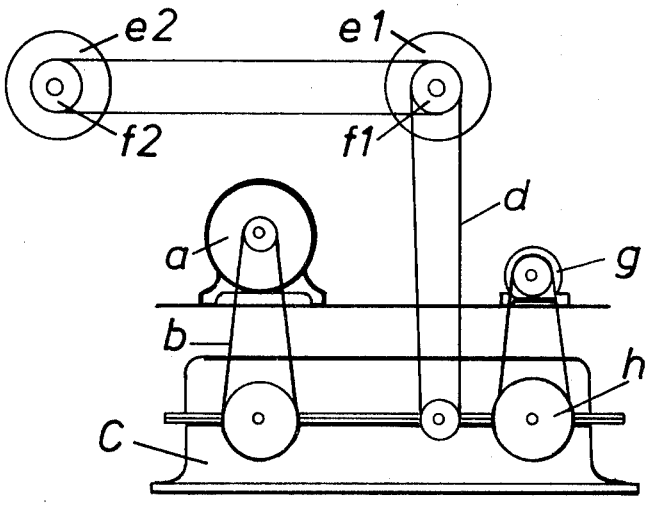
FIG. 3 is a schematic side view of the speed controlling arrangement according to the present invention.

In FIG. 3 there is illustrated a controlling arrangement in which the main drive which is indicated generally at A in FIG. 4 consists of a motor *a* which drives through a belt drive *b* the input to an infinitely variable speed gear box indicated at C. The output shaft of the gear box C is connected to one of the shafts of the drums *e*1 or *e*2 through slipping clutches *f*1 and *f*2. The relative speed between the input shaft and the output shaft of the infinitely variable speed gear box C is controlled by rotation of a shaft *h* which is driven by a fractional horsepower motor *g* through a belt drive. Thus, by rotating shaft *h* in say a clockwise direction the ratio between the input shaft and the output shaft is increased and by rotating *h* in a counter-clockwise direction the ratio between the input shaft and the output shaft of the infinitely variable gear-box C is reduced.

Thus, it will be appreciated that by applying an electrical signal to the small motor *g* in a positive or negative sense the motor *g* will rotate in either a clockwise or counter-clockwise direction to rotate the controlling shaft *h* in said direction and that said signal will thus vary the drive ratio between the motor *a* and the take-up spool which may be either *e*1 or *e*2 as the case may be. The clutches *f*1 and *f*2 controlling the drive shafts of the drums *e*1 and *e*2 may desirably be electromagnetic clutches so interconnected that the clutch *f*2 is in an 'on' position while clutch *f*1 is in an 'off' position thus providing drive from the output shaft of the infinitely variable speed gear-box C direct to the drum *e*2 or, in an alternative position, the clutch *f*2 is disengaged while the clutch *f*1 is engaged providing drive direct to the drum *e*1, so that the web can be progressed from *e*1 to *e*2 or from *e*2 to *e*1 as desired.

It a web has been wound from one drum or spool *e*1 or *e*2 to the other and it is desired to rewind it back again it is necessary to adjust the ratio of drive between motor *a* and the take-up spool relatively quickly. This is because, as the diameter of the take-up spool increases, the ratio of drive between motor *a* and said spool decreases. Therefore when the motor *a* is reversed it will be driving the former supply spool (now the take-up spool) at the slowest speed. Hence the need to adjust the drive ratio of the infinitely variable gear box to the required ratio as quickly as possible.

The present invention provides a novel and simple method of ensuring the constant linear speed of travel of a web from a source of supply of said web to a take-up spool.

It will also be appreciated that various refinements and modifications of the arrangement and herein described and hereinafter claimed are possible. For example certain variations in the disposition of the micro-switch 27 and 28 may be desirable in order to accommodate the rate or frequency of the signal to the micro-motor *g*. For example, if a relatively thick fabric is being wound from *e*1 to *e*2 it will be appreciated that the increase in diameter of the take-up spool will be substantially greater than when a relatively thin fabric is being wound and thus the rate and frequency of the signals to *g* may desirably be more frequent than in the case of the thin fabric.

What we claim is:

1. Apparatus for controlling the linear speed of a web travelling from a supply to a take-up, comprising drive means for advancing the web from said supply to said take-up; sensing means for sensing the actual speed of the advancing web; comparing means for making a comparison of the sensed actual speed with a reference speed, including a first shaft which is adapted to rotate in dependence upon the actual speed of the web, a second shaft, a synchronous motor rotating said second shaft at said reference speed and in the same direction as said first shaft, and means for determining relative angular displacement of said shafts including a disk on each of said shafts and rotatable therewith, a first electrical contact on one and a pair of second electrical contacts on the other of said disks, said first contact being arranged to engage one of said second contacts in response to relative circumferential displacement of said disks; and adjusting means for adjusting the operation of said drive means in accordance with the engagement of said first contact with either of said second contacts.

2. Apparatus for controlling the linear speed of a web travelling from a supply to a take-up, drive means for advancing the web from said supply to said take-up; sensing means for sensing the actual speed of the advancing web; comparing means for making a comparison of the sensed actual speed with a reference speed, including a first shaft which is adapted to rotate in dependence upon the actual speed of the web, a second shaft, a synchronous motor rotating said second shaft at said reference speed and in the same direction as said first shaft, and means for determining relative angular displacement of said shafts including a disk on each of said shafts and rotatable therewith, a first electrical contact on one and at least one second electrical contact on the other of said disks and arranged to engage one another in response to relative circumferential displacement of said disks; and adjusting means for adjusting the operation of said drive means in accordance with the engagement of said first contact with said at least one second contact.

3. Apparatus as defined in claim 2, wherein said determining means further comprises conductive means, including stationary terminals, and slip ring means mounted on the respective shafts for rotation therewith and operative for connecting said contacts to the respective terminals.

4. Apparatus as defined in claim 2, said drive means comprising a motor; and wherein said adjusting means comprises a variable-speed gearing having an input shaft driven by said motor, and an output shaft, and means for varying the gear ratio between said input shaft and said output shaft according to the results of said comparison.

5. Apparatus as defined in claim 4, wherein said varying means comprises a micro-motor.

6. Apparatus for controlling the linear speed of a web travelling from a supply to a take-up, drive means for advancing the web from said supply to said take-up; sensing means for sensing the actual speed of the advancing web; comparing means for making a comparison of the sensed actual speed with a reference speed, including a first shaft which is adapted to rotate in dependence upon the actual speed of the web, a second shaft, a synchronous motor rotating said second shaft at said reference speed and in the same direction as said first shaft, and means for determining relative angular displacement of said shafts including a disk on each of said shafts and rotatable therewith, a pair of circumferentially spaced electrical contacts on one of said disks, and another electrical contact on the other of said disks and located intermediate the contacts of said pair when said actual and reference speeds coincide, said other contact being adapted to engage a contact of said pair when said actual and reference speeds deviate from one another; and adjusting means for adjusting the operation of said drive means in accordance with the engagement of said other contact with one of said pair of contacts.

* * * * *